US006974047B2

(12) United States Patent
Kelley et al.

(10) Patent No.: US 6,974,047 B2
(45) Date of Patent: Dec. 13, 2005

(54) RECTANGULAR CONTAINER WITH COOPERATING VACUUM PANELS AND RIBS ON ADJACENT SIDES

(75) Inventors: Paul V. Kelley, Thurmont, MD (US); Richard Ogg, Littlestown, PA (US); David Melrose, Aukland (NZ); Seungyeol Hong, York, PA (US); John Denner, York, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 10/727,042

(22) Filed: Dec. 4, 2003

(65) Prior Publication Data

US 2004/0129669 A1 Jul. 8, 2004

Related U.S. Application Data

(60) Provisional application No. 60/430,944, filed on Dec. 5, 2002.

(51) Int. Cl.[7] ..... B65D 1/46; B65D 23/00

(52) U.S. Cl. ..... 215/381; 215/383; 220/669; 220/675

(58) Field of Search ..... 215/381–384, 215/398; 220/609, 666, 669, 675, 771

(56) References Cited

U.S. PATENT DOCUMENTS

| | | | | | |
|---|---|---|---|---|---|
| 3,537,498 | A | * | 11/1970 | Amand | 604/403 |
| 4,877,141 | A | * | 10/1989 | Hayashi et al. | 215/381 |
| 5,165,557 | A | * | 11/1992 | Ota et al. | 215/384 |
| 5,178,290 | A | * | 1/1993 | Ota et al. | 215/382 |
| 5,199,588 | A | * | 4/1993 | Hayashi | 215/381 |
| 5,222,615 | A | * | 6/1993 | Ota et al. | 215/375 |
| 5,224,614 | A | | 7/1993 | Bono et al. | |
| 5,238,129 | A | * | 8/1993 | Ota | 215/381 |
| 5,337,909 | A | | 8/1994 | Vailliencourt | |
| 5,350,078 | A | | 9/1994 | Potts et al. | |
| 5,392,937 | A | | 2/1995 | Prevot et al. | |
| 5,472,105 | A | * | 12/1995 | Krishnakumar et al. | 215/384 |
| 5,758,790 | A | * | 6/1998 | Ewing, Jr. | 215/384 |
| 5,762,221 | A | | 6/1998 | Tobias et al. | |
| 5,803,289 | A | | 9/1998 | Brady | |
| D420,919 | S | | 2/2000 | Ogg | |
| 6,036,037 | A | * | 3/2000 | Scheffer et al. | 215/381 |
| 6,044,997 | A | | 4/2000 | Ogg | |
| 6,223,920 | B1 | * | 5/2001 | Lane et al. | 215/384 |
| 6,257,433 | B1 | | 7/2001 | Ogg et al. | |
| 6,273,282 | B1 | | 8/2001 | Ogg et al. | |
| 6,277,321 | B1 | * | 8/2001 | Vailliencourt et al. | 264/529 |
| D447,411 | S | | 9/2001 | Lichtman et al. | |
| 6,575,321 | B2 | | 6/2003 | Bourque et al. | |
| 2001/0030167 | A1 | * | 10/2001 | Mooney | |
| 2003/0136754 | A1 | | 7/2003 | Bourque et al. | |

FOREIGN PATENT DOCUMENTS

| | | |
|---|---|---|
| WO | WO 97/34808 | 9/1997 |
| WO | WO 00/50309 | 8/2000 |

*Primary Examiner*—Sue A. Weaver
(74) *Attorney, Agent, or Firm*—Venable LLP; James R. Burdett; Keith G. Haddaway

* cited by examiner

(57) ABSTRACT

The present invention provides an improved blow molded plastic non-round container having generally rectangular sidewalls that are adapted for hot-fill applications. The hot-fill container has two adjacent sides one with a vacuum panel and the other with a series of ribs in the label mounting area on the sidewalls. The opposing sidewalls are symmetric relative to the vacuum panel and rib shape and placement. The ribs and vacuum panel cooperate to resist container upon filling and cooling and also improves bumper denting resistance, ease of manufacture and light weight capability.

18 Claims, 2 Drawing Sheets

RECTANGULAR CONTAINER WITH COOPERATING VACUUM PANELS AND RIBS ON ADJACENT SIDES

This is a non-provisional application of provisional application No. 60/430,944 filed Dec. 5, 2002, which is incorporated herein by reference.

BACKGROUND OF THE INVENTION

1. Field of the Invention

The present invention relates to hot-fillable containers. More particularly, the present invention relates to hot-fillable containers having vacuum panels.

2. Statement of the Prior Art

The use of blow molded plastic containers for packaging "hot-fill" beverages is well known. However, a container that is used for hot-fill applications is subject to additional mechanical stresses on the container that result in the container being more likely to fail during storage or handling. For example, it has been found that the thin sidewalls of the container deform or collapse as the container is being filled with hot fluids. In addition, the rigidity of the container decreases immediately after the hot-fill liquid is introduced into the container. As the liquid cools, the liquid shrinks in volume, which, in turn, produces a negative pressure or vacuum in the container. The container must be able to withstand such changes in pressure without failure.

Hot-fill containers typically comprise substantially rectangular vacuum panels that are designed to collapse inwardly after the container has been filled with hot liquid. However, the inward flexing of the panels caused by the hot-fill vacuum creates high stress points at the top and bottom edges of the vacuum panels, especially at the upper and lower corners of the panels. These stress points weaken the portions of the sidewall near the edges of the panels, allowing the sidewall to collapse inwardly during handling of the container or when containers are stacked together. See, for example, U.S. Pat. No. 5,337,909.

The presence of annular reinforcement ribs that extend continuously around the circumference of the container sidewall are shown in U.S. Pat. No. 5,337,909. These ribs are indicated as supporting the vacuum panels at their upper and lower edges. This holds the edges fixed, while permitting the center portions of the vacuum panels to flex inwardly while the bottle is being filled. These ribs also resist the deformation of the vacuum panels. The reinforcement ribs can merge with the edges of the vacuum panels at the edge of the label upper and lower mounting panels.

Another hot-fill container having reinforcement ribs is disclosed in WO 97/34808. The container comprises a label mounting area having an upper and lower series of peripherally spaced, short, horizontal ribs separated endwise by label mount areas. It is stated that each upper and lower rib is located within the label mount section and is centered above or below, respectively, one of the lands. The container further comprises several rectangular vacuum panels that also experience high stress point at the corners of the collapse panels. These ribs stiffen the container adjacent lower corners of the collapse panels.

Stretch blow molded containers such as hot-filled PET juice containers, must be able to maintain their function, shape and labelability on cool down to room temperature or refrigeration. In the case of non-round containers, this is more challenging due to the fact that the level of orientation and, therefore, crystallinity is inherently lower in the front and back than on the narrower sides. Since the front and back are normally where vacuum panels are located, these areas must be made thicker to compensate for their relatively lower strength.

SUMMARY OF THE INVENTION

The present invention provides an improved blow molded non-round plastic container, where an efficient vacuum absorption panel is placed on symmetrically opposing sidewalls, which sidewall is on the axis furthest from the center point. In contrast, on the axis closest to the center point, the symmetrically opposing sidewalls may be reinforced with ribs. In addition the design allows for improved dent resistance, reduces container weight and improves label panel support.

The design of the invention insures that the generally rectangular sides remain relatively flat which facilitates packing in box-shaped containers and the utilization of shelves when displayed in stores for retail sale. The containers may be resistant to bellying out, which renders them suitable for a variety of uses including hot-fill applications.

In hot-fill applications, the plastic container is filled with a liquid that is above room temperature and then sealed so that the cooling of the liquid creates a reduced volume in the container. The non-round hot-fill container of the present invention has four generally rectangular sides and a roughly rectangular base. The opposing sidewalls, having the greatest distance between them, contain the generally rectangular vacuum panels. These panels may be symmetrical to each other in size and shape. These panels have substantially curved upper and lower ends, as opposed to the substantially straight upper and lower ends. These sidewalls containing the vacuum panels may in addition contain one or more ribs located above or below the panels. These optional ribs may also be symmetric to ribs, in size, shape and number to ribs on the opposing sidewall containing the symmetric vacuum panel. The ribs have a rounded edge, which may point inward or outward relative to the interior of the container.

The vacuum panels may be selected so that they are highly efficient. See, for example, International Application No. PCT/NZ00/00019 (Melrose) where panels with vacuum panel geometry are shown.

Sidewalls not containing the vacuum panels have one or more ribs located in the label may be defined by an upper bumper and a lower bumper. The ribs can have either an outer or inner edge relative to the inside of the container. These ribs may occur as a series of parallel ribs. These ribs may be parallel to each other and the base. The number of ribs within the series can be either an odd or even. The number, size and shape of ribs may be symmetric to those in the opposing sidewall. Such symmetry enhances stability of the container.

Preferably, the ribs on the side not containing the vacuum panel may be substantially identical to each other in size and shape. The individual ribs can extend across the length or width the container. The actual length, width and depth of the rib may vary depending on container use, plastic material employed and the demands of the manufacturing process. Each rib is spaced apart relative to the others to optimize its and the overall stabilization function as an inward or outward rib. The ribs may be parallel to one another and preferably, also to the container base.

In addition, the novel design of the hot-fill container also provides for additional areas on the label mounting area for receiving an adhesive or for contact with a shrink wrap label, thereby improving the process for applying a label to the container.

The advanced highly efficient design of the side vacuum panels more than compensates for the fact that they offer less surface area than normal front and back panels. Employment of a thin-walled, super lightweight preform insures that a high level of orientation and crystallinity may be imparted to the entire package. This increased level of strength together with the rib structure and highly efficient vacuum panels provide the container with the ability to maintain function and shape on cool down, while at the same time utilizing minimum gram weight.

The arrangement of ribs and vacuum panels on adjacent sides within the area defined by upper and lower label bumpers allows the package to be further light weighted without loss of structural strength. The ribs may be placed on the weaker side and the panels may be placed on the more oriented side, which allows one to thin these sidewalls and achieve a lighter overall weigh. This configuration optimizes orientation and crystalinity. Further, this configuration of ribs and vacuum panel represents a departure from tradition.

These and various other advantages and features of novelty, which characterize the invention, are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE INVENTION

A thin-walled container in accordance with the present invention is intended to be filled with a liquid at a temperature above room temperature. According to the invention, a container may be formed from a plastic material such as polyethylene terephthlate (PET) or polyester. Preferably, the container is blow molded. The container can be filled by automated, high speed, hot-fill equipment known in the art.

Figure 1:
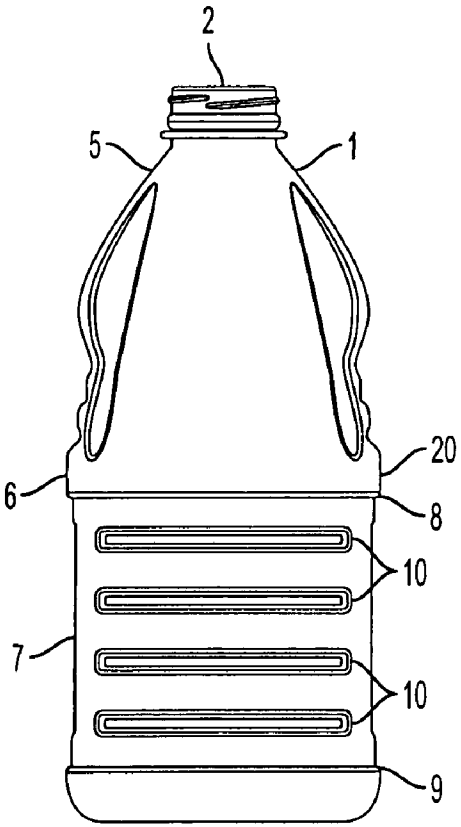
FIG. 1 shows a side view of the container along the longer base side showing the embodiment having a series of symmetrical ribs.

Referring now to the drawings, a preferred embodiment of the container of this invention is indicated generally in FIG. 1, as generally having many of the well-known features of hot-fill bottles. The non-round container (1), substantially rectangular parallelepiped shape, has a longitudinal axis when the container is standing upright on its base. The container comprises a threaded neck (2) for filling and dispensing fluid. Neck (2) also is sealable with a cap (not shown). The preferred container further comprises a roughly rectangular base (4) and a shoulder (5) located below neck (2) and above base (4). The container of the present invention also has a body (6) defined by roughly rectangular sides (20) that connect shoulder (5) and base (4). The body of the preferred container has at least one label mounting area (7) that are located between upper label bumper (8) and lower label bumper (9). A label or labels can be applied to one or more of the label mounting areas using methods that are well known to those skilled in the art, including shrink wrap labeling and adhesive methods. As applied, the label extends either around the entire body of the container or extends over the entirety or a portion of the label mounting area.

Generally, the substantially rectangular sides not having vacuum panels containing one or more ribs (10) are those with a width greater than those sidewalls containing the vacuum panels (11) in the label area. The sides having the vacuum panels (11) are adjacent to those having the ribs (10) in the label areas defined by an upper and lower bumpers. Further, the sides having the vacuum panels may also have one or more ribs (10') located in areas above and/or below the vacuum panels. The placement of the vacuum panel (11) and the ribs (10 and 10') are such that the opposing sides are symmetrical. These vacuum panels (11) have rounded edges. The vacuum panels (11) permit the bottle to flex inwardly upon filling with the hot fluid, sealing, and subsequent cooling. The ribs (10 and 10') can have a rounded outer or inner edge, relative to the space defined by the sides of the container. The ribs typically extend most of the width of the side and are parallel with each other and the base. The width is of these ribs is selected consistent with the achieving the rib function. The number of ribs on either adjacent side can vary depending on container size, rib number, plastic composition, bottle filling conditions and expected contents. Preferably, the side containing ribs in the panel area has an even number of ribs with an inner edge. The placement of ribs on a side can also vary so long as the desired goal(s) associated with the interfunctioning of the ribs and the vacuum panels is not lost. The ribs are also spaced apart from the upper and lower edges of the vacuum panels, respectively, and are placed to maximize their function. The ribs of each series are noncontinuous, i.e., they do not touch each other. Nor do they touch a panel edge.

The substantially rectangular sides containing the vacuum panels may contain one or more ribs (10'). These ribs are parallel to the base and where more than one are present are parallel to each other. These ribs generally have inward edges.

The number of vacuum panels is variable. However, two symmetrical panels, each on the opposite sides of the container, are preferred. The vacuum panel (11) is substantially rectangular in shape and has a rounded upper edge (14), a rounded lower edge (15), substantially straight rounded side edges (16) and (17), and a panel portion (11) that is intermediate the upper and lower edges. The upper edges of the vacuum panels are spaced apart from the upper label bumper (8) (or the upper label mount area) and the lower edge of the vacuum panels are spaced apart from the lower label bumper (9) (or the lower label mount area). The vacuum panels maybe covered by the label once it is applied to the container.

Figure 2:
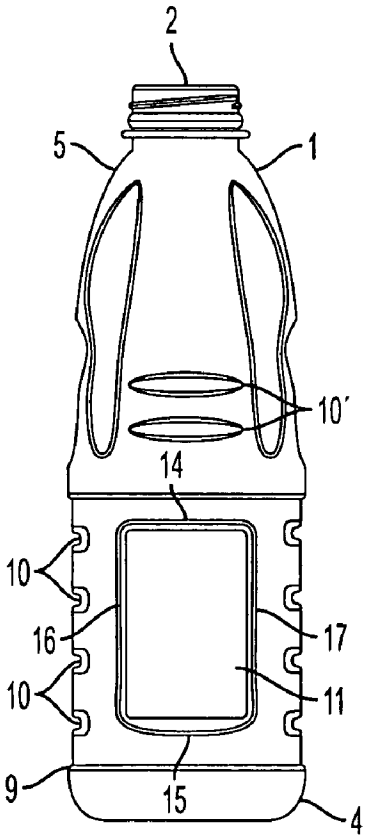
FIG. 2 shows a side view of the container along the shorter base side showing the side panel having a vacuum panel and the embodiment where there is a series of ribs positioned above the panel.

As shown in FIG. 2, the narrower side containing the vacuum panel in the label area along with a side view of a series of ribs, present on the adjacent sides in the label area. Also depicted in FIG. 2, are optional ribs, located above the vacuum panel. Of course, the number of ribs and optional ribs may vary, although it is preferred that the length and configuration of each rib is substantially identically to that of the remaining ribs of the series. It is also preferred that the ribs are positioned on a side so that they correspond in positioning and size to their counterparts on the opposite rectangular side of the container.

Figure 3:
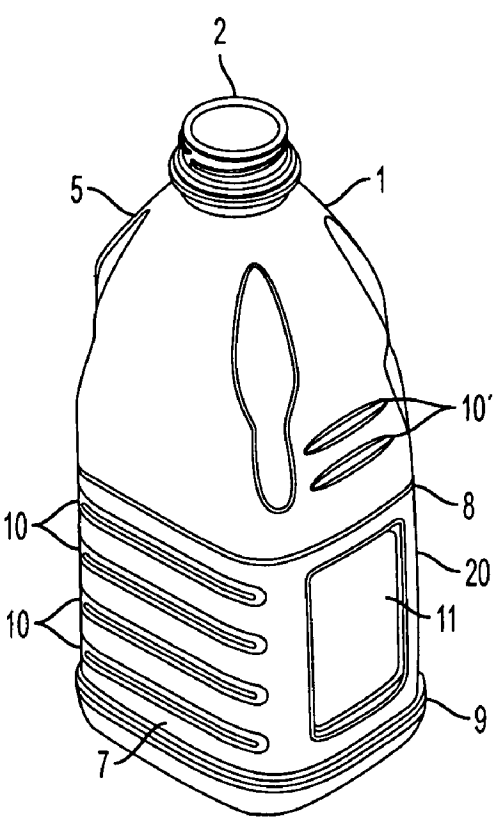
FIG. 3 shows a corner view showing adjacent sidewalls having respectively the vacuum panel and the rib structure.

The corner view shown in FIG. 3 shows a preferred placement of the label area ribs relative to the side containing the vacuum panel and the optional ribs.

Figure 5B:
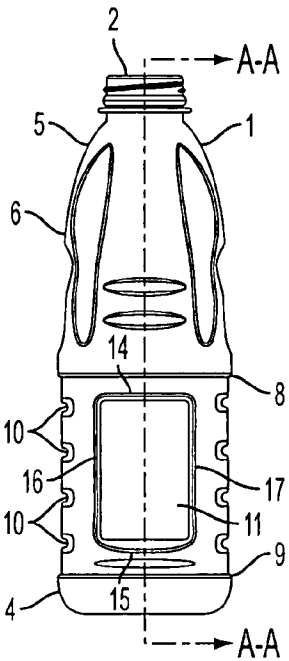
FIGS. 5A and 5B show a front and side view, respectively, for one embodiment of the container and provides dimensions for that embodiment. Also shown is an A—A axis and a B—B axis, respectively.
Figure 5A:
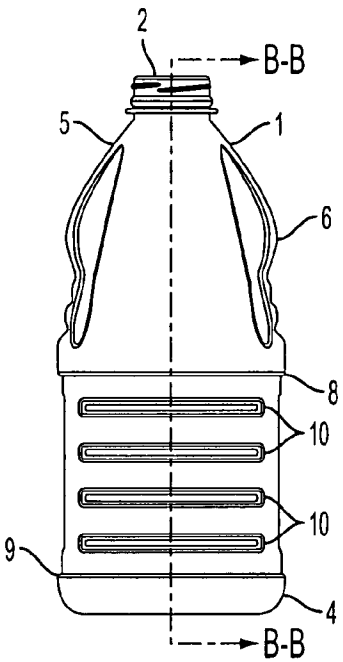

For a 64-ounce plastic container having an outer perimeter of approximately 414 mm and as depicted in FIGS. 5A and 5B, the vertical length of the vacuum panels is approximately 77 mm and the width of the panel is approximately 51 or 55 mm. The height of the depicted container is about 262 mm. The length and width of the base are, respectively, about 118 mm by about 94 or 89 mm. The depicted ribs have a length of 95 mm and width of approximately 9 mm. The depicted distance between adjacent ribs is approximately 13 mm, as measured from the respective inner edges. The depth of the depicted ribs in the label area is approximately 3 mm. The distance from the outer edge of upper most rib to the outer edge of the lowest rib, as depicted on the front side of the container, is approximately 74 mm.

Figure 4:
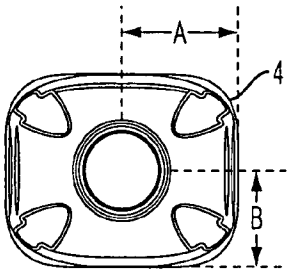
FIG. 4 shows a view of the base showing dimension A and dimension B. Dimension A is the distance from the center point of the base to the sidewall containing the vacuum panel within the label area. Dimension B is the distance from the center point of the base to the sidewall containing the rib structures within the label area.
Figure 6:
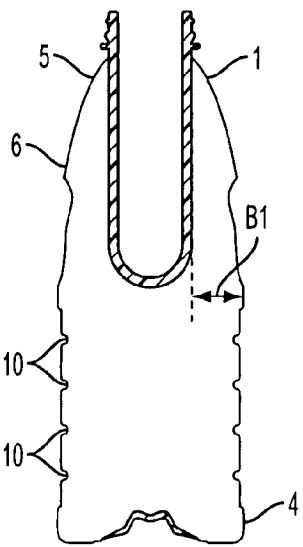
FIG. 6 is a sectioned view along the axis B—B shown in FIG. 5A, illustrating the rib cross sections.
Figure 7:
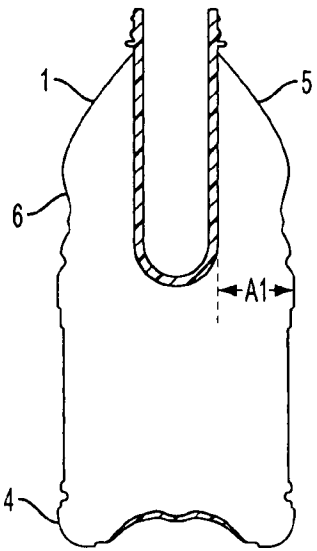
FIG. 7 is a sectional view along the axis A—A shown in FIG. 5B, illustrating the vacuum panel cross section.

The part can be non-round in such away that the face with the ribs Dimension B (see FIG. 4) from the center must be smaller than the face with the vacuum panel Dimension A (see FIG. 4) from the center (the most common geometry would be rectangular). The corresponding preform will be closer to the sidewall at Dimension B1 (see FIG. 6) than at the sidewall dimension A1 (see FIG. 7). This creates the setup in where in blow molding the preform into the bottle creates the different level of orientation.

The above is offered by way of example only, and the size of the reinforcement rib is a function of the size of the container, and would be increased from the values given in proportion to an increase in the dimensions of the container from the dimensions given for container (1).

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

All references cited in this specification are hereby incorporated by reference. The discussion of the references herein is intended merely to summarize the assertions made by their authors and no admission is made that any reference constitutes prior art relevant to patentability. Applicants reserve the right to challenge the accuracy and pertinency of the cited references.

What we claim as our invention is:

1. A thin-walled, plastic container having a body portion, said body portion having generally rectangular sidewalls and a base wherein said body portion comprises a label mounting area, on at least two of the adjacent rectangular sidewalls, extending between an upper label bumper and a lower label bumper, said label mounting area comprising: a substantially generally rectangular vacuum panel having an upper and lower edge on one sidewall, and a plurality of ribs positioned in the label area on the sidewall adjacent to the side wall containing the vacuum panel, said ribs having either an outward or inwardly facing rounded edges, relative to the interior of the container, wherein said ribs are parallel to each other.

2. The plastic container of claim 1, wherein at least one of said adjacent sidewalls is symmetrical to an opposing side wall relative to rib and vacuum panel placement, size and number.

3. The plastic container of claim 1, wherein the sidewall containing the vacuum panel has a width that is less than the width of the adjacent sidewall containing ribs in the label area.

4. The plastic container of claim 3, wherein at least one of said adjacent sidewalls is symmetrical to an opposing side wall relative to rib and vacuum panel placement, size and number.

5. The plastic container of claim 1, wherein the sidewall containing the vacuum panel has one or a plurality of ribs above or below the vacuum panel.

6. The plastic container of claim 5, wherein at least one of said adjacent sidewalls is symmetrical to an opposing side wall relative to rib and vacuum panel placement, size and number.

7. The plastic container of claim 1, wherein the ribs and vacuum panels cooperate to maintain container shape upon filling and cooling of the container.

8. The plastic container of claim 1, wherein the container is made of PET.

9. The plastic container of claim 1, wherein the container is hot-fillable.

10. The plastic container of claim 1, wherein the base is non-rounded.

11. The plastic container of claim 1, wherein the sidewall containing the vacuum panel has one rib above the vacuum panel.

12. The plastic container of claim 11, wherein at least one of said adjacent sidewalls is symmetrical to an opposing side wall relative to rib and vacuum panel placement, size and number.

13. The plastic container of claim 1, wherein the sidewall containing the vacuum panel has one rib below the vacuum panel.

14. The plastic container of claim 13, wherein at least one of said adjacent sidewalls is symmetrical to an opposing side wall relative to rib and vacuum panel placement, size and number.

15. The plastic container of claim 1, wherein the sidewall containing the vacuum panel has a plurality of ribs above the vacuum panel.

16. The plastic container of claim 15, wherein at least one of said adjacent sidewalls is symmetrical to an opposing side wall relative to rib and vacuum panel placement, size and number.

17. The plastic container of claim 1, wherein the sidewall containing the vacuum panel has a plurality of ribs below the vacuum panel.

18. The plastic container of claim 17, wherein at least one of said adjacent sidewalls is symmetrical to an opposing side wall relative to rib and vacuum panel placement, size and number.

* * * * *